US012535292B2

(12) United States Patent
Lawrie

(10) Patent No.: US 12,535,292 B2
(45) Date of Patent: Jan. 27, 2026

(54) SYSTEMS AND METHODS OF HANDGUN AND HOLSTER SAFETY AND SECURITY

(71) Applicant: David Lawrie, Crozet, VA (US)

(72) Inventor: David Lawrie, Crozet, VA (US)

(73) Assignee: David Lawrie, Crozet, VA (US)

( * ) Notice: Subject to any disclaimer, the term of this patent is extended or adjusted under 35 U.S.C. 154(b) by 521 days.

(21) Appl. No.: 17/897,174

(22) Filed: Aug. 28, 2022

(65) Prior Publication Data

US 2024/0068770 A1 Feb. 29, 2024

(51) Int. Cl.
*F41C 33/02* (2006.01)

(52) U.S. Cl.
CPC ..... *F41C 33/0263* (2013.01); *F41C 33/0209* (2013.01); *F41C 33/029* (2013.01)

(58) Field of Classification Search
CPC ..... F41A 17/066; F41A 17/54; F41A 17/06; F41C 33/0263; F41C 33/029
See application file for complete search history.

(56) References Cited

U.S. PATENT DOCUMENTS

| | | | | |
|---|---|---|---|---|
| 6,412,207 | B1 * | 7/2002 | Crye | F41A 17/02 42/70.08 |
| 6,735,897 | B1 * | 5/2004 | Schmitter | F41A 17/063 42/70.11 |
| 9,816,779 | B2 * | 11/2017 | Moon | F41C 33/0263 |
| 11,060,812 | B2 * | 7/2021 | Black | G08B 13/2448 |
| 11,073,352 | B1 * | 7/2021 | Radcliff | F41A 17/44 |
| 11,300,381 | B2 * | 4/2022 | Bernkrant | F41C 33/029 |
| 11,365,946 | B2 * | 6/2022 | Lawrie | F41A 17/063 |
| 2017/0284755 | A1 * | 10/2017 | Farringer | F41C 33/0209 |
| 2019/0186868 | A1 * | 6/2019 | Cordero Pardo | F41C 33/029 |

* cited by examiner

*Primary Examiner* — Corey N Skurdal

(57) ABSTRACT

A method for securely maintaining a handgun in a holster is provided. The method comprises a secure handgun holster receiving, at a circuit board within the holster, contact from a lever within the holster, the contact resulting from pushing action of the lever; The method also comprises the holster waking up the circuit board based on the received contact. The method also comprises the holster verifying, via an authorized user detection process executed at least by the circuit board, that a provider of the push action is an authorized user of a handgun presently held by the holster. The method also comprises the holster activating, based on the verification, an unlocking process. The method also comprises the holster releasing the handgun based on completion of the unlocking process.

16 Claims, 11 Drawing Sheets

SYSTEMS AND METHODS OF HANDGUN AND HOLSTER SAFETY AND SECURITY

CROSS REFERENCE TO RELATED APPLICATIONS

None

FIELD OF THE DISCLOSURE

The present disclosure is in the field of handgun safety and security. More particularly, the present disclosure provides systems and methods of handgun and holster safety and security in which a holster holding a handgun is locked and can only be unlocked by placement of an external near field communication (NFC) antenna proximate to an NFC antenna located inside the holster.

BACKGROUND

Handgun safety is an increasingly contentious subject in the US and elsewhere. Thousands of Americans die each year because of intentional handgun use during crimes or suicide. But thousands more Americans die each year because of handgun accidents and misuse, deaths that could be prevented. A national debate rages about more tightly controlling firearm distribution and ownership.

Law enforcement officers who engage in physical struggles or altercations with suspects are at risk of injury or death when suspects manage to remove an officer's firearm from the firearm's holster or if the firearm should fall or be jarred from the holster. Bystanders are also at risk if a suspect takes possession of the firearm or if the firearm discharges during an altercation or when the firearm hits the ground.

Americans are told to always keep their firearm pointed in a safe direction and never point a gun at anything they do not intend to shoot. Americans are also instructed to treat all guns as though they are loaded, keep fingers away from the trigger until ready to shoot, and to be certain of target and what is beyond the target.

The holster and its proper handling are nearly as important as the handgun itself and its handling. Four rules for holster safety are often suggested. First is trigger guard coverage. The holster should be flush to each side of the trigger guard with no gaps or space between the holster and the trigger guard. Second is retention wherein the firearm will not fall from the holster. Holsters with poor retention are bad for a few reasons. There is room for foreign objects to get into the holster and obstruct the user's draw. Also, if a hostile party is wrestling the user for the firearm, it should be difficult for the hostile party to pull the firearm from the holster.

A third commonly suggested rule for holster safety is full firing grip access. A user should be able to get his/her hand to the full grip of the handgun. If the user's fingers are hitting any part of the holster when the user begins to draw, the holster fails this test. Fourth and finally, the holster should be non-collapsible. When the user draws a firearm, the holster should not collapse or close as this makes it hard to re-holster safely. Many negligent discharges happen when users are fumbling with the muzzle trying to re-holster into a flattened holster.

DETAILED DESCRIPTION

Figure 1:
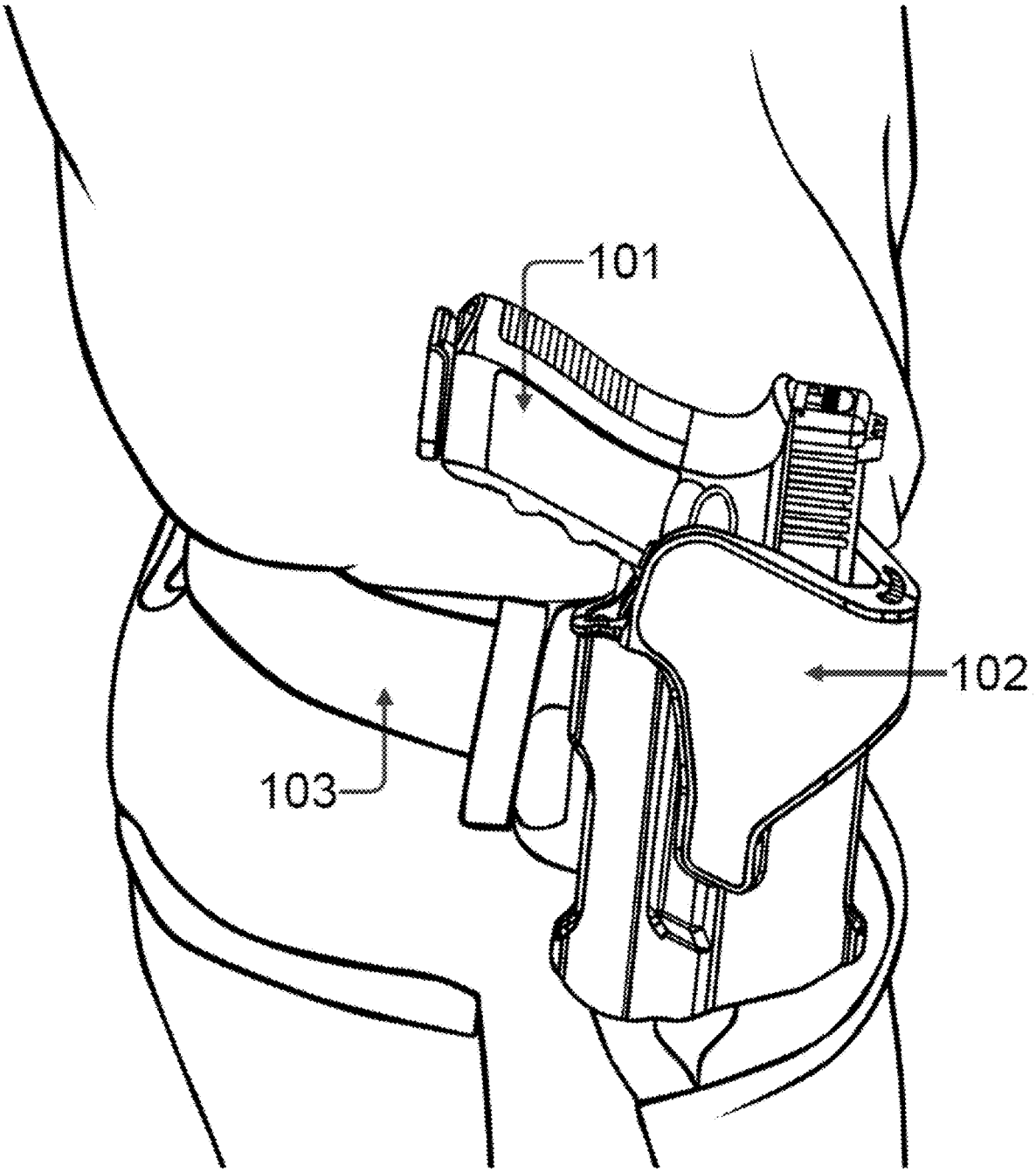
FIG. 1 is a diagram of a system of handgun and holster safety and security in accordance with an embodiment of the present disclosure.

Systems and methods described herein provide a secure holster system for holding and releasing a handgun only to authorized parties. To receive authorization to draw a handgun from the holster system provided herein, a party must produce electronic media that uses near-field communication (NFC). The holster system initially conducts an authorized user detection process to determine that a party attempting to unlock the holster and thereby gain access to the handgun has produced such NFC media.

Once the party produces the required media, that may be a small, portable antenna and the media is authorized by the system, the system then commences an unlocking process. The system activates an internal motor that turns a locking bolt arm. This action causes an ejection port locking bolt to swing away from the held firearm and discontinue blocking removal of the firearm. The firearm is thus available to be drawn from the holster.

When the user thereafter places the firearm back in the holster, the holster automatically returns to locked state. If the same user desires to draw the handgun again, even if immediately after replacing it, the user must follow the authorized user detection process in full. The process as described herein takes less than a second which may be critical in an emergency requiring decisive action.

Much of the functionality provided herein executes on a circuit board contained within the holster. The circuit board, via at least firmware, after directing an onboard NFC antenna to begin scanning, contacts a data store to determine whether a proximate party is authorized to draw the firearm. Upon determining that the party is authorized, the circuit board then activates the motor, and instructs the motor to unlock the holster. The circuit board also has control over non-mechanical components such as firmware, the data store, the onboard antenna, and an accelerometer for detecting when the holster with handgun inserted and locked has been moved.

An authorized user detection process begins when an intended user moves an unlock lever, the top of which protrudes from a top area of the holster. This action "wakes up" the circuit board which causes the onboard antenna to begin scanning. The onboard antenna is an NFC antenna that receives contact with an external NFC antenna carried by the authorized user on a ring or similar object. The user may bring the ring close to an area of the outer surface of the holster beneath which is positioned over the onboard antenna.

The onboard antenna detects the presence of the external antenna positioned nearby and reads a serial number from the external antenna. The circuit board consults a local data store for a listing of serial numbers of authorized users. If the serial number received from the external antenna is included in the listing, the user of the external antenna is authorized, and the system may then begin an unlocking process.

To unlock the holster and allow the handgun to be drawn, the circuit board, having completed authorization, instructs the motor to activate. The motor turns a locking bolt arm which is attached to an ejection port locking bolt. The ejection port locking bolt effectively swings out and away from the body of the holster, unblocking the firearm.

When in closed position, a portion of the ejection port locking bolt protrudes into the body of the holster through an ejection port. This protruding portion is referred to herein as the bolt extension. When the ejection port locking bolt is closed and therefore flush against the body of the holster, the bolt extension lodges into a recessed area of the handgun. This structure and action hold the handgun in place and prevents the handgun from being drawn from the holster. The action of the motor when activated results in the ejection port locking bolt swinging out and withdrawing the bolt extension from its usual lodged position in the recessed area of the handgun. The handgun may then be drawn.

The movement and positioning of the ejection port locking bolt determines whether the handgun may be drawn. The circuit board, via its control over the motor, controls whether the ejection port locking bolt is open, thus allowing the handgun to be removed, or closed, effectively locking the handgun into the holster.

Turning to the figures, FIG. 1 is a diagram of a holster security system 100 according to an embodiment of the present disclosure. FIG. 1 illustrates a midsection area of a user's body with handgun 101, holster 102, and belt 103 for attachment of holster. The portion of the holster 102 that is shown in FIG. 1 may be a steel cover that conceals and protects the electronic and mechanical components of the system 100.

Figure 2:
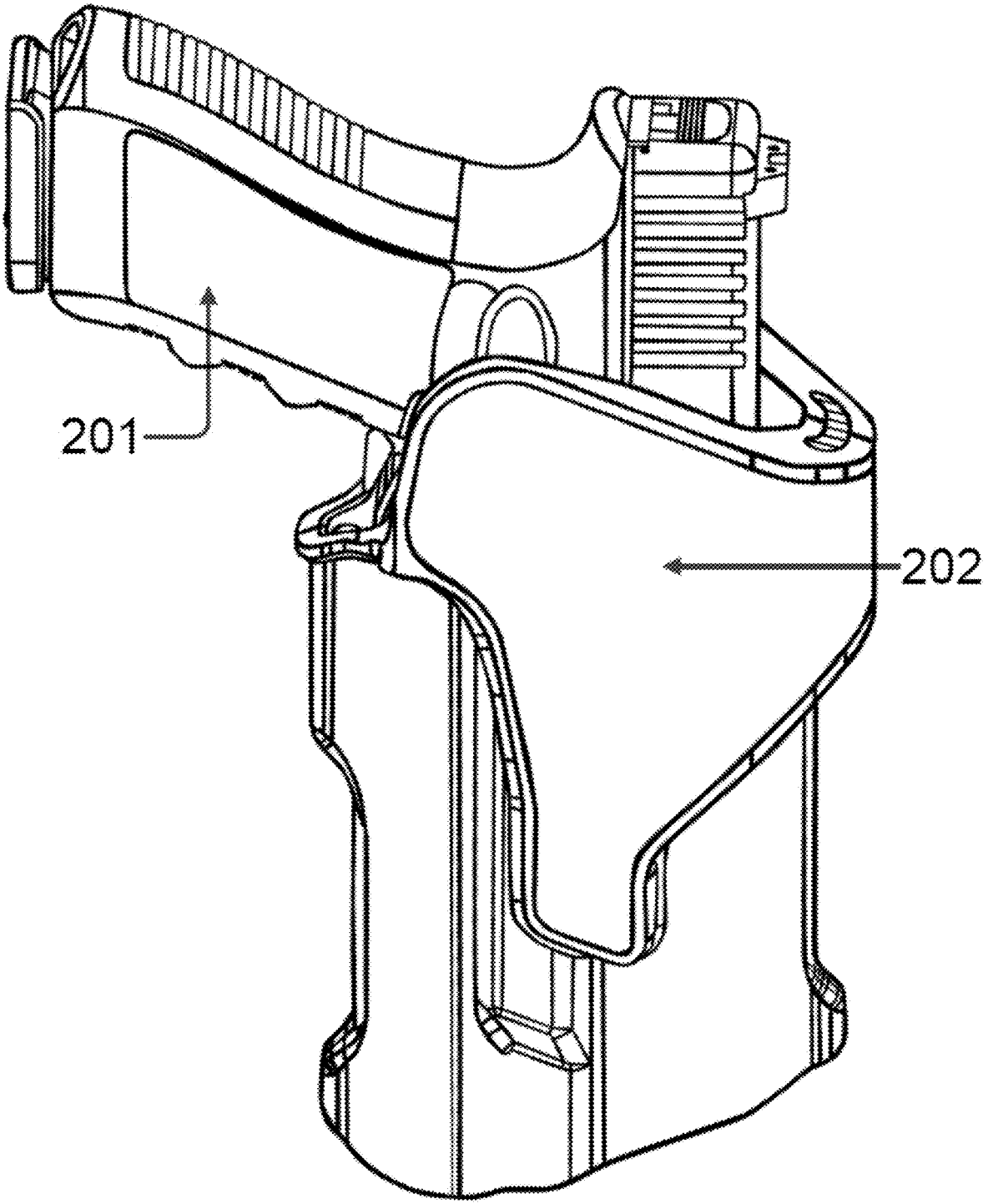
FIG. 2 is a diagram of a system of handgun and holster safety and security in accordance with an embodiment of the present disclosure.

While components depicted and enumerated in FIG. 2 through FIG. 10 may not in all cases be indexed to and are not numbered in a manner similar to the components shown in FIG. 1, components in all of the figures are intended to be components of a single system, regardless of their numbering. FIG. 2 depicts the handgun 201 and the holster 202.

Figure 3:
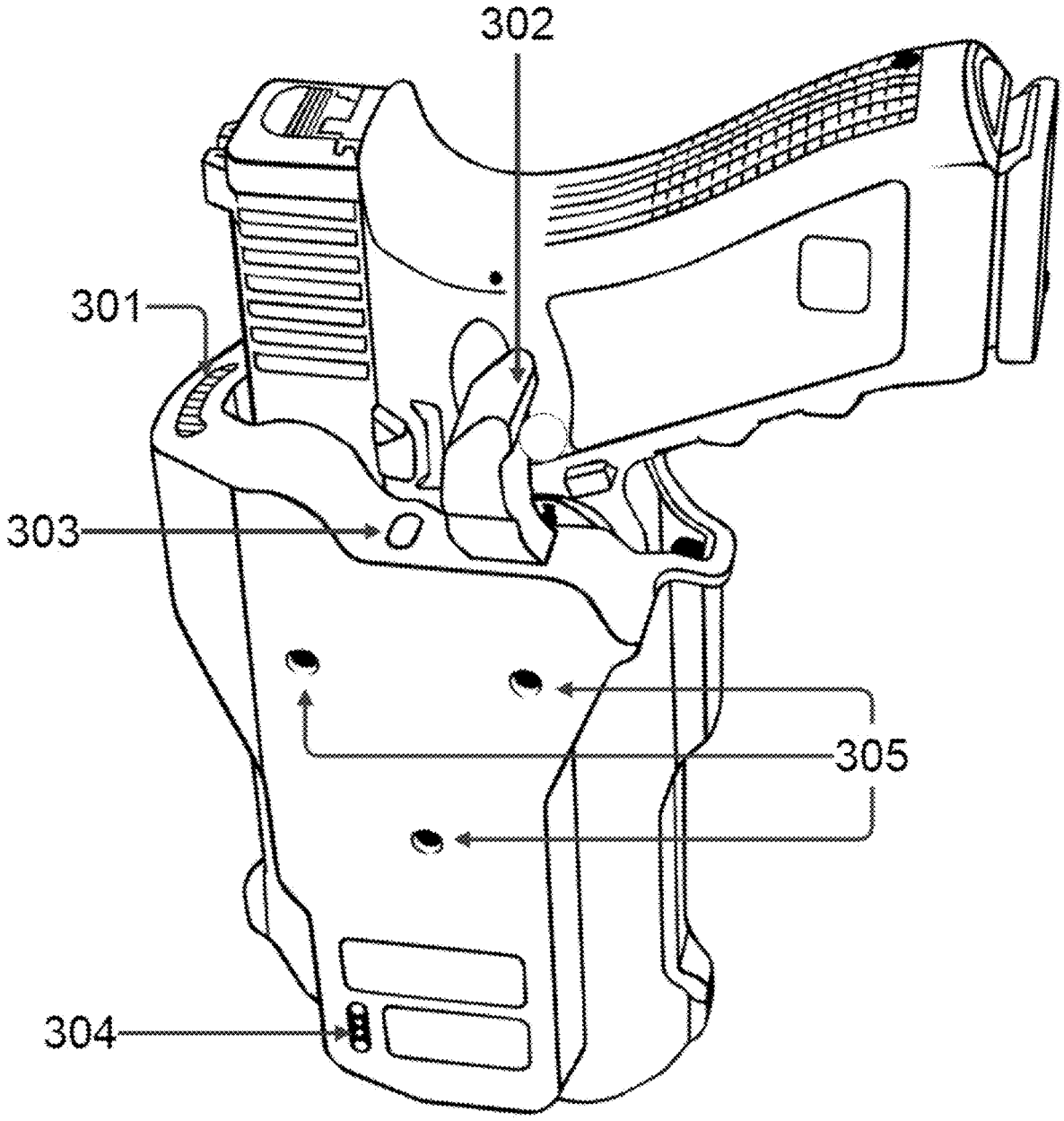
FIG. 3 is a diagram of a system of handgun and holster safety and security in accordance with an embodiment of the present disclosure.

FIG. 3 depicts a back side or side opposite that shown in FIG. 1 and FIG. 2. FIG. 3 depicts an LED indicator light 301 to indicate locking of system, unlocking of system, and charging status of battery.

Also shown in FIG. 3 is an unlock lever 302. To initiate unlocking, a user would manually push the unlock lever 302 forward. This action is what wakes up the circuit board and results in the onboard antenna to begin scanning for the external antenna provided by the intended user who a moment earlier pushed the unlock lever 302 forward.

The mode button 303 is used to place the system in alarm mode as well as configuration mode. These two modes, which involve a mobile device separate from the holster, are described in detail later.

The charging port 304 is used to charge the system. The holes 305 are for connection to a waist belt clip.

Figure 4:
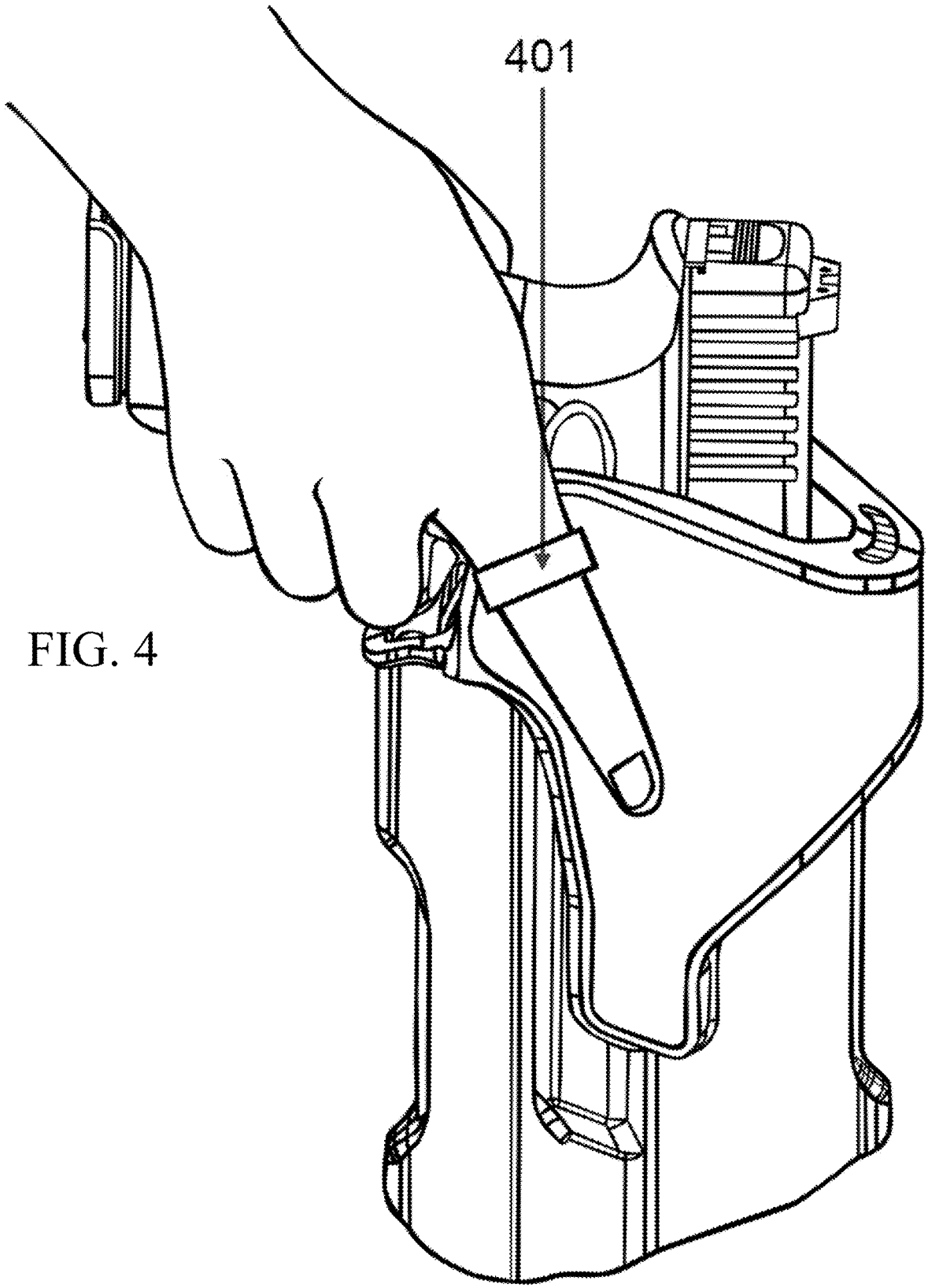
FIG. 4 is a diagram of a system of handgun and holster safety and security in accordance with an embodiment of the present disclosure.

FIG. 4 illustrates a user's hand and index finger with ring 401 in place. The ring 401 has an NFC antenna attached or incorporated into it, described above as an external antenna. When the user positions the ring 401 proximate the area of the holster 102 where the onboard antenna is located, the onboard antenna, when it is scanning, detects the presence of the external antenna using NFC. The onboard antenna would be able to read the serial number of the external antenna and have the circuit board use that serial number to determine if the user wearing the ring or otherwise placing the external antenna proximate the holster is authorized. While the user is shown as wearing the ring 401, in embodiments the external antenna need not be embedded into a ring and may instead be part of a different type of object, for example a keychain.

Figure 5:
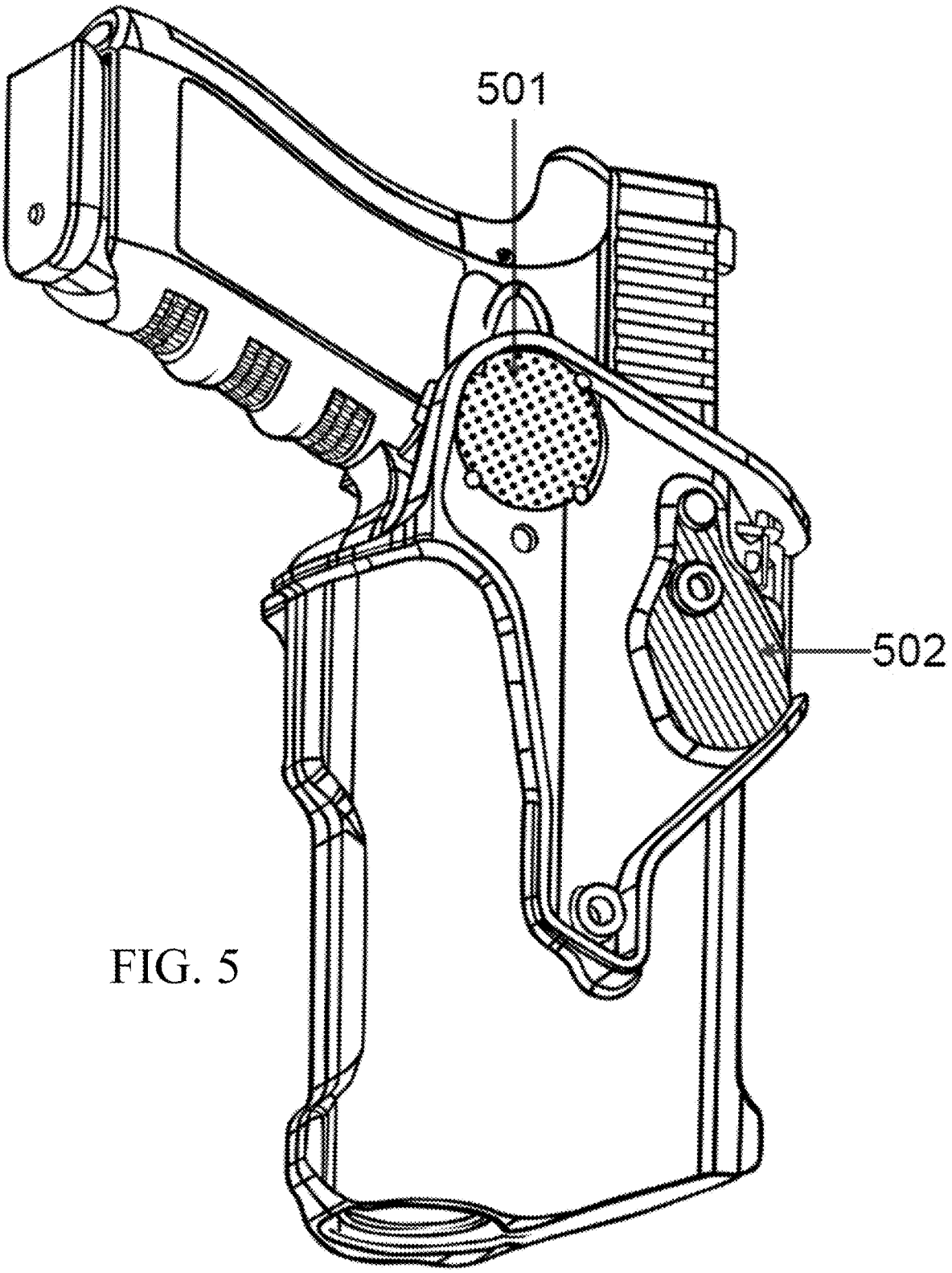
FIG. 5 is a diagram of a system of handgun and holster safety and security in accordance with an embodiment of the present disclosure.

FIG. 5 illustrates the front side of the holster with its cover removed. Illustrated are the onboard antenna 501 for ring detection and the ejection port locking bolt 502. The party seeking authorization to use the handgun would position the ring 401 in the upper left area of the holster as in FIG. 4 to be proximate the antenna 501 such that the antenna 501 detects the presence of the external antenna on the ring.

Figure 6:
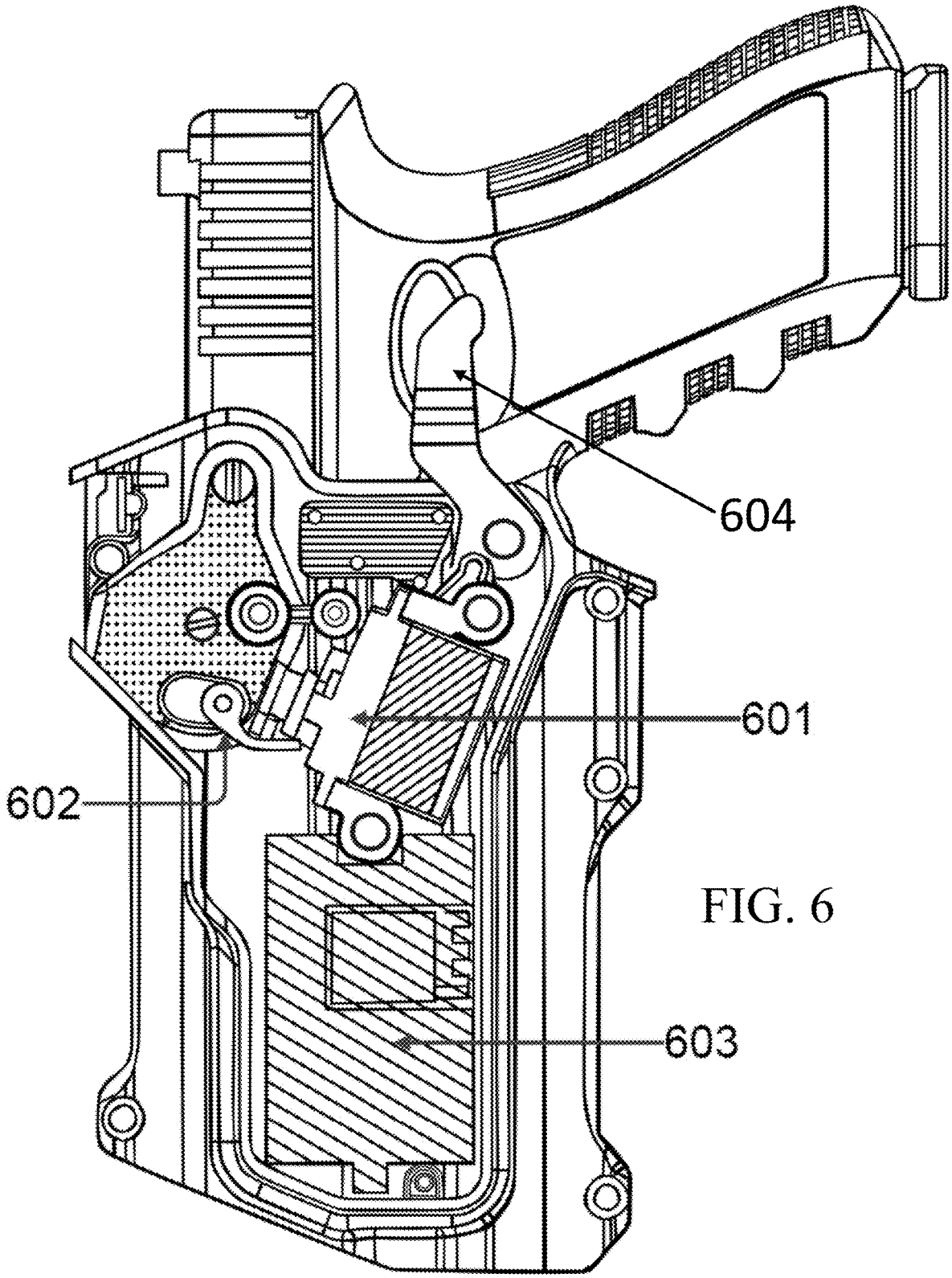
FIG. 6 is a diagram of a system of handgun and holster safety and security in accordance with an embodiment of the present disclosure.

FIG. 6 illustrates an internal view of the system from a backside perspective with the cover of the backside (shown in FIG. 3) removed in FIG. 6. Shown in FIG. 6 are the motor 601, the locking bolt arm 602, the circuit board 603, and the lever 604. Incorporated into or attached to the circuit board are at least a battery, firmware, data store, and accelerometer.

Figure 7:
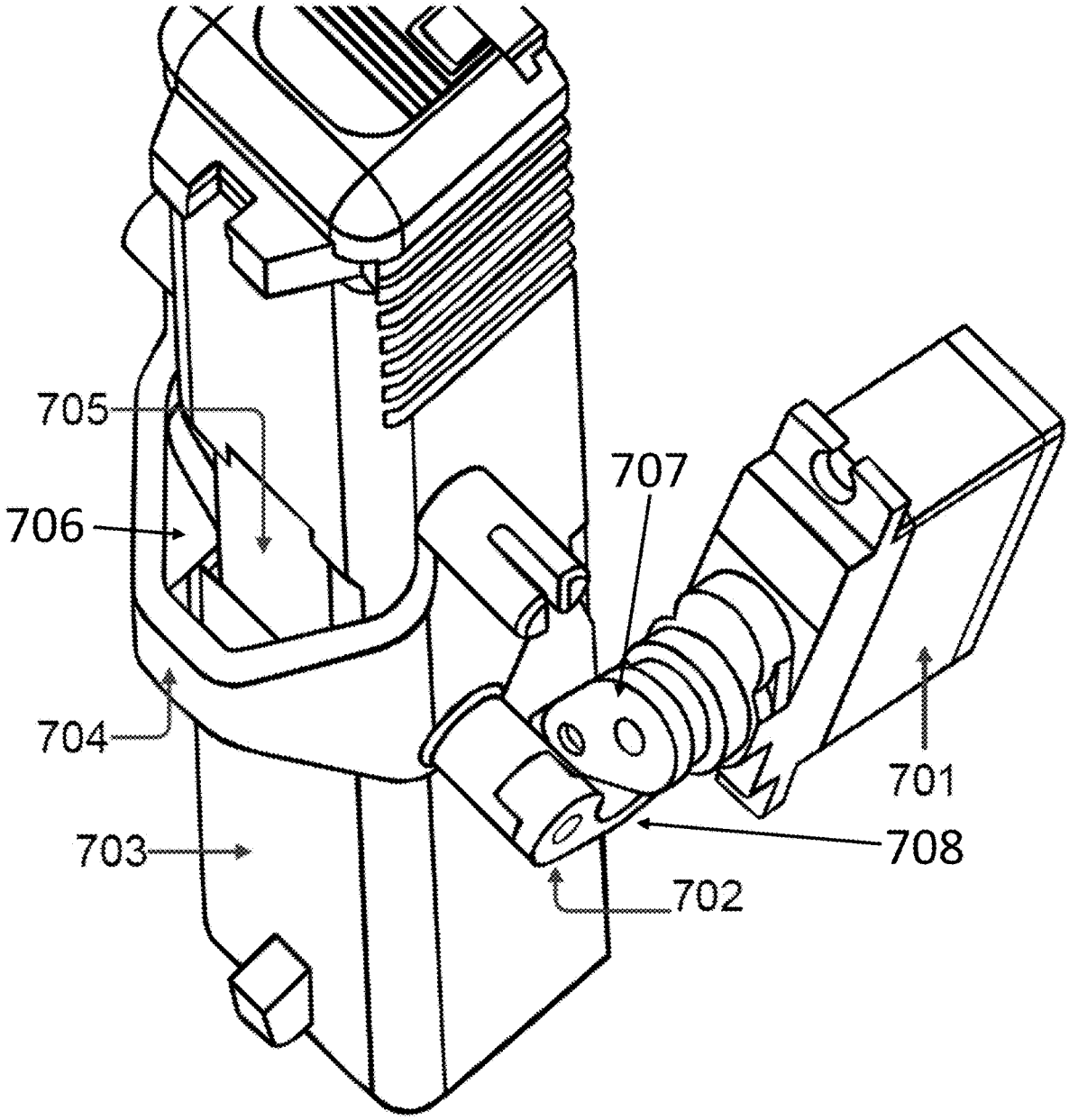
FIG. 7 is a diagram of a system of handgun and holster safety and security in accordance with an embodiment of the present disclosure.

FIG. 7 depicts the motor 701, the locking bolt arm 702, a pistol slide 703, the ejection port locking bolt 704, the ejection port 705, the bolt extension 706, a motor turning head 707, and an arm extension 708. After the circuit board 603 completes the authorized user detection process as described above, the circuit board 603 instructs the motor 701 to open or effectively move the ejection port locking bolt 704, action which allows the handgun to be removed. The motor 701 turns the motor turning head 707. This action causes an arm extension 708 of the locking bolt arm 702 to be pushed downward. This action results in the locking bolt arm 702 being turned in a clockwise direction (in the perspective provided in FIG. 7). The turning of the locking bolt arm 702 causes the ejection port locking bolt 704 to swing outward and away from the firearm. This is more clearly illustrated in FIG. 8 discussed below.

In FIG. 7, the ejection port locking bolt 704 is shown in closed position. The bolt extension 706, which is physically part of the ejection port locking bolt 704, is shown as positioned partially against or into a recessed area of the firearm and is partially obstructed in the view of FIG. 7. This structure and positioning holds the firearm into the holster. The firearm cannot be moved because the bolt extension 706 is blocking the firearm from being moved.

Figure 8:
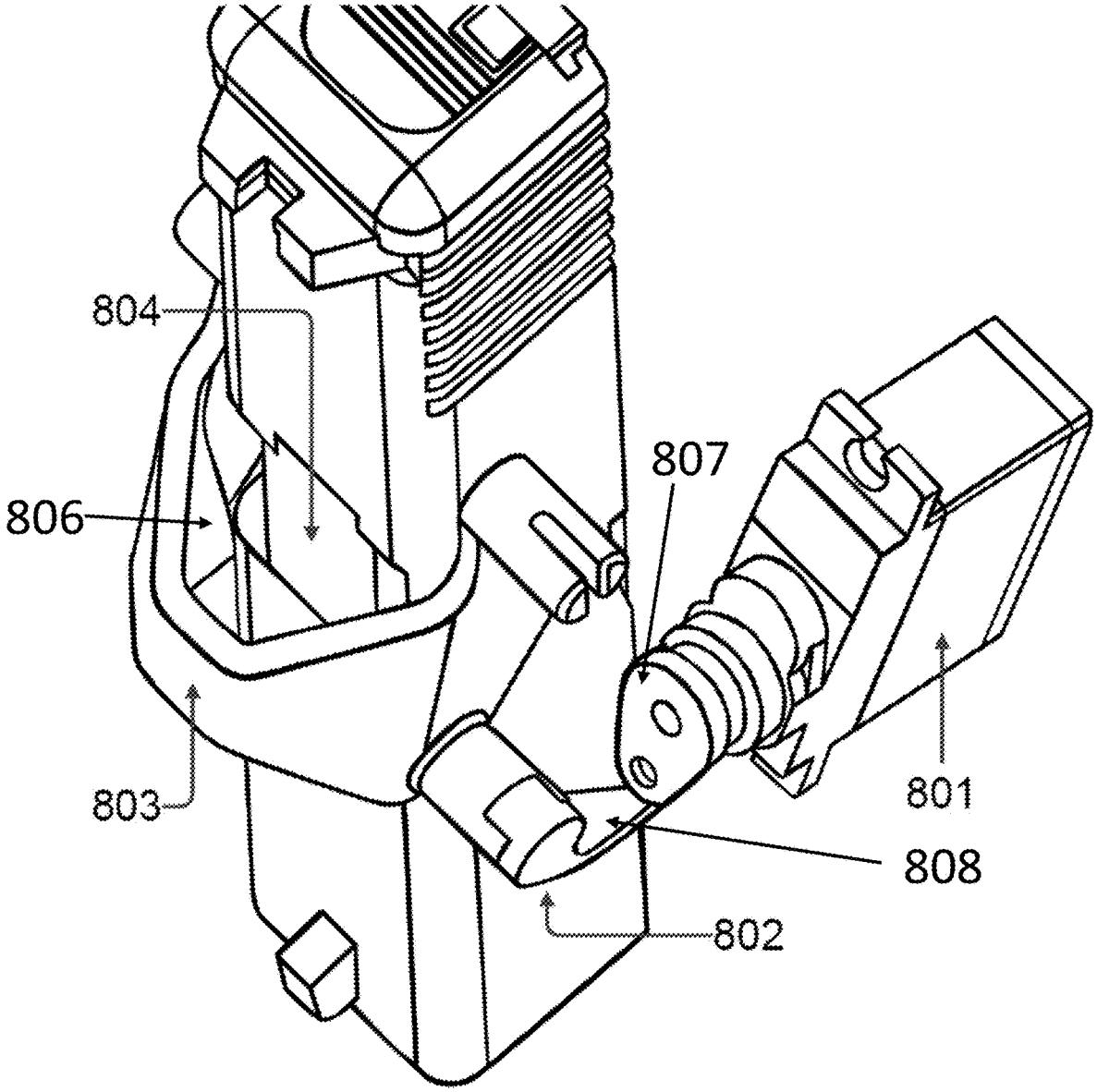
FIG. 8 is a diagram of a system of handgun and holster safety and security in accordance with an embodiment of the present disclosure.

FIG. 8 depicts the same components as in FIG. 7. Whereas FIG. 7 showed the system in closed position such that the firearm was locked into the holster, FIG. 8 shows the system in open position such that the firearm can be removed.

FIG. 8 depicts the motor 801, the locking bolt arm 802, the ejection port locking bolt 803, the ejection port 804, and the bolt extension 806. FIG. 8 also depicts the newly introduced components from FIG. 7 which in FIG. 8 are the bolt extension 806, the motor turning head 807, and the arm extension 808.

FIG. 8 shows how the motor 801 turns the motor turning head 807 which pushes the arm extension 808 downward. A comparison of the motor turning head 807 in FIG. 8 with the motor turning head 707 in FIG. 7 will reveal that the motor turning head shown 807 in FIG. 8 is pointing downward whereas the motor turning head 707 in FIG. 7 is only turned sideways. The downward position of the motor turning head 807 in FIG. 8 reveals the more downward pushing of the arm extension 808, action that results in a further turning of the locking bolt arm 802. The result of these interactions is that the ejection port locking bolt 803 is pushed outward and that the bolt extension 806 is drawn away from the firearm. The firearm is thus able to be removed.

Summarizing, FIG. 7 shows the system in closed state. FIG. 8 shows the system in open state.

Once the firearm has been removed, the system automatically returns to closed state with a short period, for example just a few seconds. Also, when the system is in closed state without the firearm and the user then returns the firearm to the holster, the ejection port locking bolt 803 will move slightly to allow the firearm to slide back into the holster and will automatically return to locked state. User action is not required in this sequence.

As mentioned briefly above, the system also includes an accelerometer which detects movement of the firearm and holster. The system sends a wireless message to a remote mobile device, for example a smartphone, upon such detection. FIG. 3 illustrated a mode button 303 that is used to place the system in alarm mode as well as configuration mode. In an embodiment, a user may press the mode button 303 a first quantity of times to enable the alarm mode which activates the accelerometer. In another embodiment, the user may press the mode button 303 a second or different quantity of times to enable configuration mode which would allow certain configuration actions by a user of the mobile device.

Figure 9:
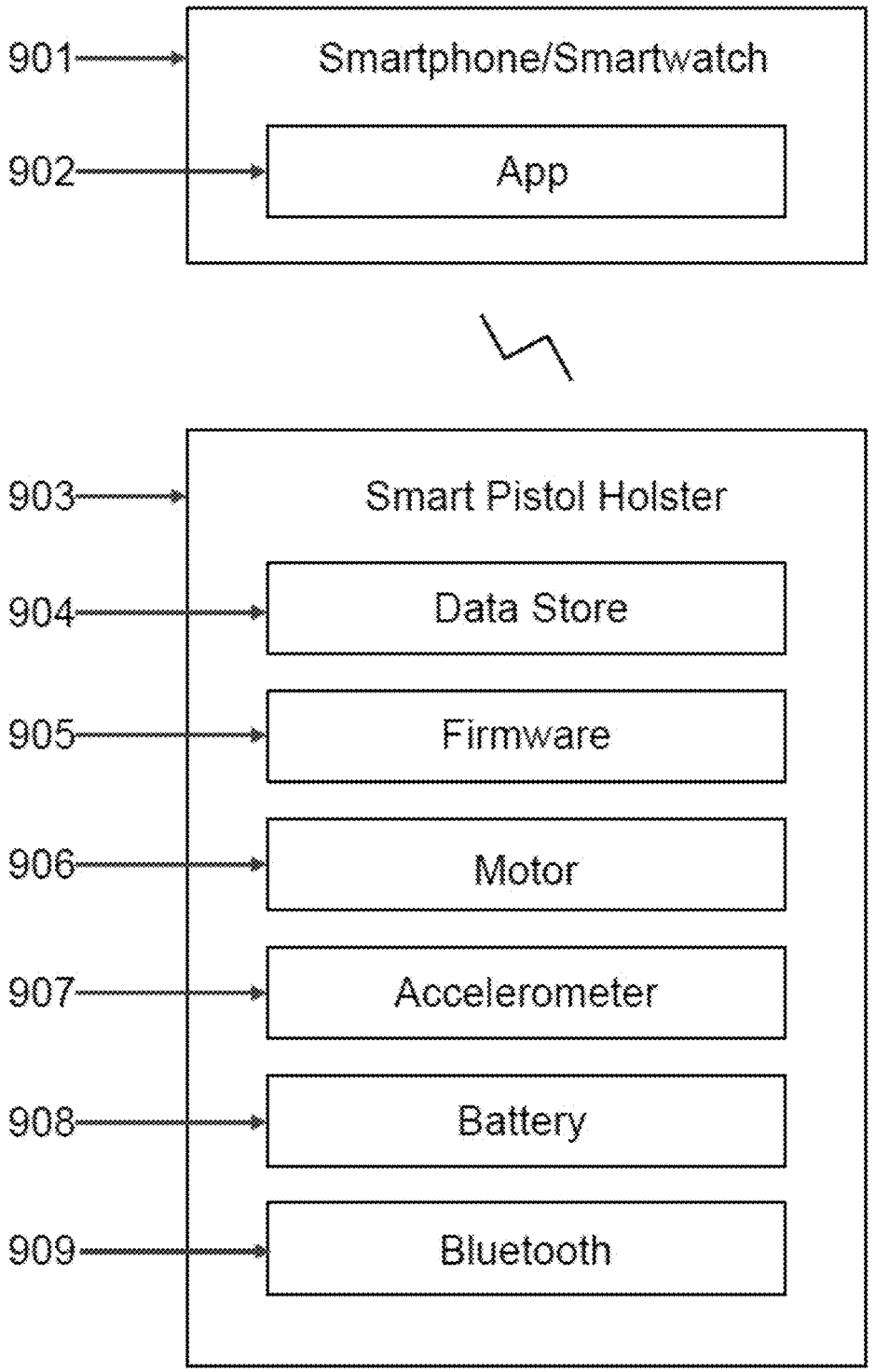
FIG. 9 is a diagram of a system of handgun and holster safety and security in accordance with an embodiment of the present disclosure.

FIG. 9 is a block diagram of a system of firearm safety according to an embodiment. FIG. 9 depicts components of a mobile device that could be carried by a handgun owner in executing some of the actions described above. FIG. 9 depicts a smartphone/smartwatch 901 with an app 902 executing thereon. The app 902 may execute some of the functionality described above.

Figure 10:
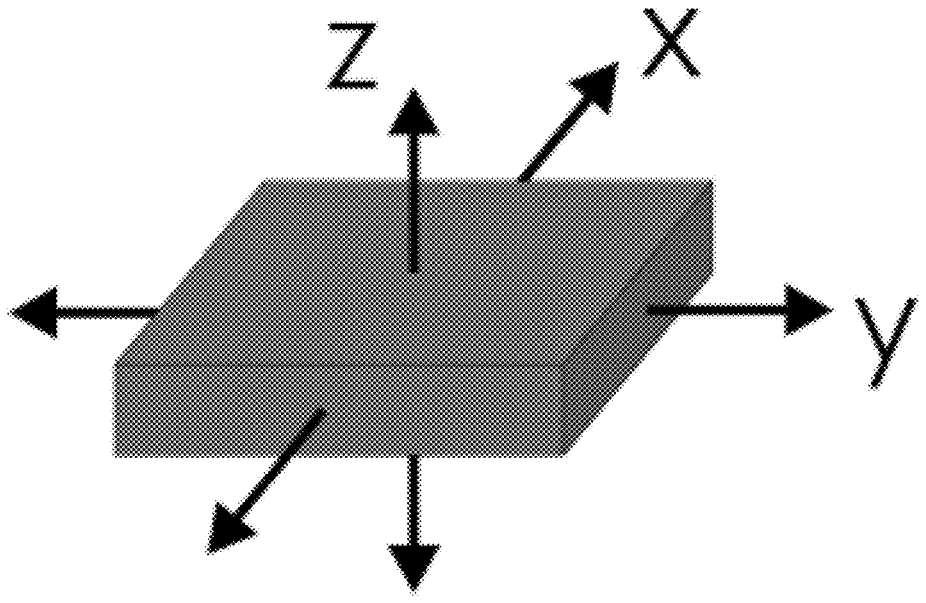
FIG. 10 is a diagram of a system of handgun and holster safety and security in accordance with an embodiment of the present disclosure.

FIG. 9 also depicts a block diagram of a smart pistol holder 903 that in an embodiment is the holster and holster system described herein. The smart pistol holder 903 includes a data store 904 and firmware 905. The smart pistol holder 903 also includes a motor 906, accelerometer 907, and battery 908. FIG. 10 is a diagram illustrating movement detection and measurement of the accelerometer.

Figure 11:
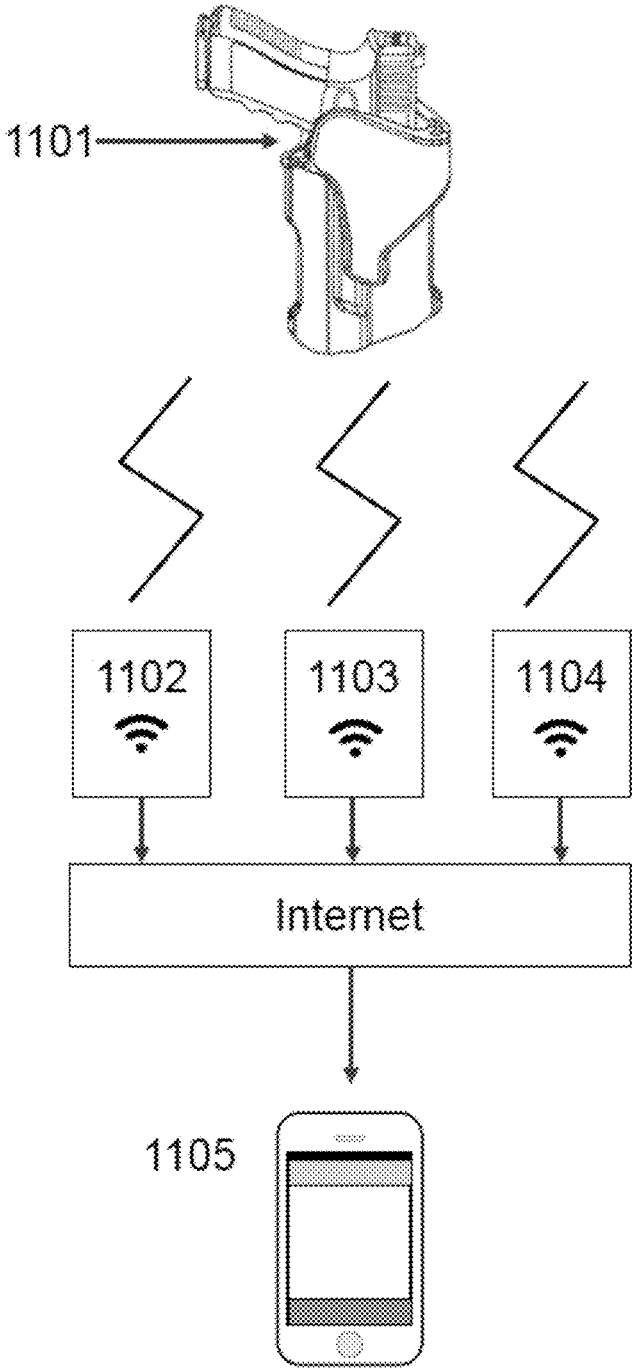
FIG. 11 is a diagram of a system of handgun and holster safety and security in accordance with an embodiment of the present disclosure.

FIG. 11 depicts the holster with firearm stored and with the holster initiating contact via WiFi connection with a mobile device 1105. In an embodiment, the circuit board 1101 in the holster contains functionality via the firmware and the data store such that when the accelerometer 907 with alarm mode activated detects movement of the holster and hence the handgun, the holster can send a warning message to the mobile device.

The mobile device, via Bluetooth connection 909 with the holster in configuration mode, preconfigures at least one WiFi hotspot connection for the holster to contact when the accelerometer detects movement. In an embodiment, more than one WiFi hotspot may be configured such that if the holster is not successful in contacting a first preconfigured configured hotspot, it attempts to contact a second preconfigured WiFi hotspot, and thereafter a third preconfigured hotspot if contacting the second is not successful. The hotspots 1102, 1103, 1104 are shown in FIG. 11. In an example, the hotspots 1102, 1103, 1104 that the user might configure could be at the user's home, at the user's workplace, and at a third location frequently visited by the user. The hotspots 1102, 1103, 1104 are also stored in the mobile device 1105.

When the holster successfully establishes contact with one of the hotspots 1102, 1103, 1104, it may then send a message to the mobile device 1105 using push messaging technology, text messaging, electronic mail, or other messaging technology. In an embodiment, the holster may also be configured via its firmware and data store to send messages to a personal computer.

In an embodiment, the holster may be outfit and configured with hardware and software for cellular communication such that the holster and the mobile device may communicate directly. This configuration would obviate the need for the WiFi connection described above although a holster could in embodiments be configured for both WiFi and cellular connection.

In an embodiment, a method for securely maintaining a handgun in a holster is provided. The method comprises a secure handgun holster receiving, at a circuit board within the holster, contact from a lever within the holster, the contact resulting from pushing action of the lever.

The method also comprises the holster waking up the circuit board based on the received contact. The method also comprises the holster verifying, via an authorized user detection process executed at least by the circuit board, that a provider of the push action is an authorized user of a handgun presently held by the holster. The method also comprises the holster activating, based on the verification, an unlocking process. The method also comprises the holster releasing the handgun based on completion of the unlocking process.

The authorized user detection process comprises the circuit board, via at least a firmware component, contacting an onboard first antenna. The authorized user detection process also comprises the circuit board determining that the onboard first antenna has received near-field electronic contact from a second antenna, the second antenna carried by the provider of the push action.

The authorized user detection process also comprises the circuit board receiving a serial number of the second antenna from the onboard first antenna. The authorized user detection process also comprises the circuit board verifying, from consulting a datastore, that the serial number is listed in the data store.

The unlocking process comprises the holster, based on the verification, activating a motor resident within the holster. The unlocking process also comprises the holster causing the motor to turn a locking bolt arm. The unlocking process also comprises the holster, based on the turning action and via the motor, moving an ejection port locking bolt away from the handgun, the handgun thus released for removal from the holster.

The second antenna is attached to a ring worn by the provider of the push action. Multiple providers are authorized to receive release of the handgun, each of the multiple providers in possession of a ring with a serial number listed in the data store. The waking up process comprising the first antenna beginning scanning for contact with the second antenna.

In another embodiment, a system for preventing unauthorized removal of a handgun from a holster is provided.

The system comprises a handgun, a holster for holding the handgun, and a holster security mechanism contained within the holster. The mechanism comprises an ejection port locking bolt, a motor, and a circuit board. The circuit board wakes up upon receipt of physical contact with a lever resident in the holster, the contact resulting from movement of the lever. The circuit board authorizes release of the handgun based on affirmative completion of an authorized user detection process. The circuit board instructs the motor to execute movement of ejection port locking bolt.

Movement of the ejection port locking bolt promotes removal of the handgun from the holster. In completing the authorized user detection process, the circuit board further contacts, via at least a firmware component, an onboard first antenna. The circuit board further determines that the onboard first antenna has received electronic contact from a second antenna, the second antenna provided by a user that caused the physical contact by initiating movement of lever.

The circuit board further receives a serial number of the second antenna from the onboard first antenna. The circuit board further verifies, from consulting a data store, that the serial number is listed in the data store. The data store contains a listing of serial numbers of second antennas associated with users authorized to remove the handgun.

In completing the unlocking process, the circuit board further activates, based on the verification, the motor. The circuit board further causes the motor to turn a locking bolt arm, the turning of the locking bolt arm moving the ejection port locking bolt away from the handgun, thus rendering the handgun available for removal from the holster. The circuit board further causes the motor, once the handgun is removed, to return the ejection port locking bolt to closed position.

Once the ejection port locking bolt is returned to closed position after removal of the handgun, in an event the handgun is placed back into the holster, the ejection port locking bolt moves slightly to allow full placement of the handgun while thereafter fully locking the handgun into the holster without a need for user action.

The second antenna is attached to a ring worn by the user. Multiple users are authorized to receive release of the handgun, each of the users in possession of a ring with a serial number listed in the data store. The waking up of the circuit board causes the first antenna to begin scanning for contact with the second antenna. A plurality of light emitting diode (LED) components flash to indicate at least one of locked status, unlocked status, and charging status of a battery resident in the holster.

In yet another embodiment, a method for promoting handgun safety and security. The method comprises a handgun holster receiving activation of a node button and the holster, based on the received activation, activating an onboard accelerometer. The method also comprises the holster receiving signals from the accelerometer, the signals indicating movement of the holster. The method also comprises the holster, based on the received signals, sending a wireless message to at least one mobile device via a first preconfigured WiFi hotspot connection, the message comprising one of a push notification message, a text message, and an electronic mail message.

The first preconfigured hotspot is saved in a data store resident in the holster with a second preconfigured hotspot and a third preconfigured hotspot, the holster initially selecting the first preconfigured hotspot and based on failure to successfully connect with the first hotspot, initiating contact with one of the second hotspot and the third hotspot.

The hotspots are preconfigured and stored in the data store via an app executing on the mobile device, the mobile device contacting the holster via Bluetooth connection.

One of additionally and alternatively the holster is configured with hardware and software for exchanging messages with the mobile device via cellular connection.

What is claimed is:

1. A method for securely maintaining a handgun in a holster, comprising:

a secure handgun holster receiving, at a circuit board within the holster, contact from a lever within the holster, the contact resulting from pushing action of the lever;

the holster waking up the circuit board based on the received contact;

the holster verifying, via an authorized user detection process executed at least by the circuit board, that a provider of the push action is an authorized user of a handgun presently held by the holster;

the holster activating, based on the verification, an unlocking process; and the holster releasing the handgun based on completion of the unlocking process.

2. The method of claim 1, wherein the authorized user detection process comprises:

the circuit board, via at least a firmware component, contacting an onboard first antenna;

the circuit board determining that the onboard first antenna has received near-field. electronic contact from a second antenna, the second antenna carried by the provider of the push action;

the circuit board receiving a serial number of the second antenna from the onboard first antenna; and the circuit board verifying, from consulting a datastore, that the serial number is listed in the data store.

3. The method of claim 1, wherein the unlocking process comprises:

the holster, based on the verification, activating a motor resident within the holster;

the holster causing the motor to turn a locking bolt arm;

the holster, based on the turning action and via the motor, moving an ejection port locking bolt away from the handgun, the handgun thus released for removal from the holster.

4. The method of claim 2, wherein the second antenna is attached to a ring worn by the provider of the push action.

5. The method of claim 3, wherein multiple providers are authorized to receive release of the handgun, each of the multiple providers in possession of a ring with a serial number listed in the data store.

6. The method of claim 1, further comprising the waking up process comprising the first antenna beginning scanning for contact with the second antenna.

7. A system for preventing unauthorized removal of a handgun from a holster, comprising:

a handgun;

a holster for holding the handgun; and a holster security mechanism contained within the holster, the mechanism comprising:

an ejection port locking bolt, a motor, and a circuit board that:

wakes up upon receipt of physical contact with a lever resident in the holster, the contact resulting from movement of the lever, authorizes release of the handgun based on affirmative completion of an authorized user detection process, and instructs the motor to execute movement of ejection port locking bolt.

8. The system of claim 7, wherein movement of the ejection port locking bolt promotes removal of the handgun from the holster.

9. The system of claim 7, wherein in completing the authorized user detection process, the circuit board further:

contacts, via at least a firmware component, an onboard first antenna, determines that the onboard first antenna has received electronic contact from a second antenna, the second antenna provided by a user that caused the physical contact by initiating movement of lever, receives a serial number of the second antenna from the onboard first antenna; and verifies, from consulting a data store, that the serial number is listed in the data store.

10. The system of claim 9, wherein the data store contains a listing of serial numbers of second antennas associated with users authorized to remove the handgun.

11. The system of claim 7, wherein in completing the unlocking process, the circuit board further:

activates, based on the verification, the motor, causes the motor to turn a locking bolt arm, the turning of the locking bolt arm moving the ejection port locking bolt away from the handgun, thus rendering the handgun available for removal from the holster, and causes the motor, once the handgun is removed, to return the ejection port locking bolt to closed position.

12. The system of claim 11, wherein once the ejection port locking bolt is returned to closed position after removal of the handgun, in an event the handgun is placed back into the holster, the ejection port locking bolt moves slightly to allow full placement of the handgun while thereafter fully locking the handgun into the holster without a need for user action.

13. The system of claim 7, wherein the second antenna is attached to a ring worn by the user.

14. The system of claim 7, wherein multiple users are authorized to receive release of the handgun, each of the users in possession of a ring with a serial number listed in the data store.

15. The system of claim 7, wherein the waking up of the circuit board causes the first antenna to begin scanning for contact with the second antenna.

16. The system of claim 7, wherein a plurality of light emitting diode (LED) components flash to indicate at least one of locked status, unlocked status, and charging status of a battery resident in the holster.

* * * * *